US005655813A

United States Patent [19]

Kirkpatrick

[11] Patent Number: 5,655,813

[45] Date of Patent: Aug. 12, 1997

[54] CONVERTIBLE SEAT COVER

[75] Inventor: Colleen Kirkpatrick, Anderson, S.C.

[73] Assignee: Saddleman, Inc., Logan, Utah

[21] Appl. No.: 607,710

[22] Filed: Feb. 27, 1996

[51] Int. Cl.[6] ..... A61G 15/00

[52] U.S. Cl. ..... 297/220; 297/228.1; 297/229

[58] Field of Search ..... 297/220, 228.1, 297/219.1, 229, 396

[56] References Cited

U.S. PATENT DOCUMENTS

| | | | |
|---|---|---|---|
| 4,078,842 | 3/1978 | Zur | 297/229 |
| 4,232,898 | 11/1980 | Bodrero | 289/228.1 |
| 4,400,030 | 8/1983 | Maruzzo et al. | 297/228.1 |
| 4,693,511 | 9/1987 | Seltzer et al. | 297/228.1 |
| 4,725,094 | 2/1988 | Greer | 292/220 |
| 5,005,901 | 4/1991 | Hinde | 297/220 X |
| 5,023,125 | 6/1991 | Gray | 297/228.1 X |
| 5,234,252 | 8/1993 | Wallach | 297/220 X |

FOREIGN PATENT DOCUMENTS

| | | | |
|---|---|---|---|
| 1194630 | 6/1970 | United Kingdom | 297/220 |

*Primary Examiner*—Peter M. Cuomo
*Assistant Examiner*—Rodney B. White
*Attorney, Agent, or Firm*—Thorpe North & Western

[57] ABSTRACT

A seat cover which fits the contour of a seat having a headrest. The cover includes a flexible headrest pocket which can be folded inwardly into the rest of the cover in order to fit the contour of a seat not having a headrest.

8 Claims, 2 Drawing Sheets

CONVERTIBLE SEAT COVER

BACKGROUND OF THE INVENTION

1. The Field of the Invention

The present invention pertains generally to the field of seat covers. More particularly, it concerns a seat cover having a concealable headrest pocket.

2. The Background Art

Seat covers have long been used for maintaining seats in good condition. Seat covers offer a number of advantages, including: protection from stains, marks and wear, and concealment of seats which have been stained, marked, discolored and worn. Seat covers also serve a cosmetic function when a cover provides new color or texture.

Attempts have been made to accommodate seats with headrests. One approach has been to place a hole or holes in the seat cover so that the headrest extends through the hole. Such covers fail to cover the headrest or protect it from additional wear. Further, seat covers very seldom match the texture, color or design of the seat, resulting in unmatching seat covers and headrests which is unappealing to many consumers.

Another approach in the art is to attach a headrest receptacle to the seat cover. When a seat has a headrest, the headrest fits into the headrest receptacle. A disadvantage of a seat cover having a headrest receptacle, until the present invention, has arisen where a seat lacked a headrest. In such cases, the headrest receptacle would neither be removable nor capable of being easily hidden. Rather, the headrest receptacle would remain on the top of the seat in an unattractive collapsed form or, if folded inside out, would form a wide edge at the opening which would not lie flat due to the layers of material around the opening.

OBJECTS AND SUMMARY OF THE INVENTION

It is therefore an object of the present invention to provide a seat cover capable of covering a headrest of the seat.

It is another object of the invention to provide such a seat cover which can both cover the seat and fit to the contour of a seat having a headrest and be converted simply and quickly to fit to the contour of the seat with the headrest removed.

It is another object of the invention to provide a seat cover that will have a narrow slot that will lie flat when the secondary pocket is folded inside-out.

The above objects and others not specifically recited are realized in a specific illustrative embodiment of a convertible seat cover. The seat cover includes a main pocket having an opening at the upper edge and a secondary pocket connected at an open lower end to the main pocket at an annular junction, such that the open lower end extends around the upper slot of the main pocket. The secondary pocket is configured and dimensioned to envelop a headrest on a seat, and is foldable inside-out to extend into the main pocket to be concealed when the headrest is removed.

The seat cover, wherein the secondary pocket is folded inside-out, fits the backrest of a seat. The secondary pocket is folded inside-out at the annular junction, which forms a slot. The slot closes to form a narrow slit which lies flat along and against the backrest of the seat, concealing the secondary pocket.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
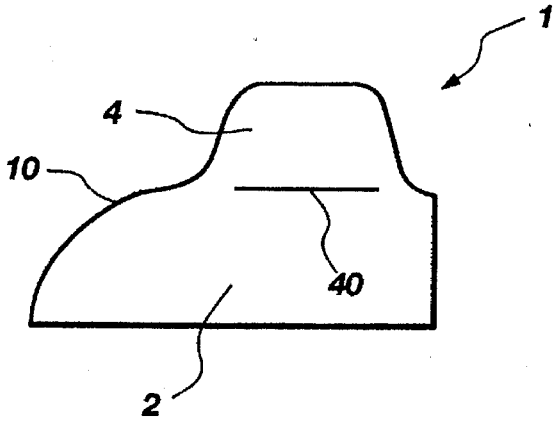
FIG. 1 is a frontal view of a cover made in accordance with the principles of the present invention.
Figure 2:
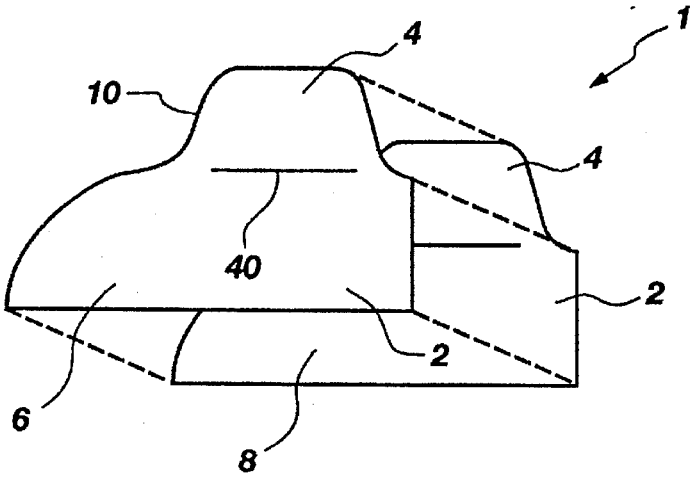
FIG. 2 is an exploded frontal view of the cover of FIG. 1.
Figure 5:
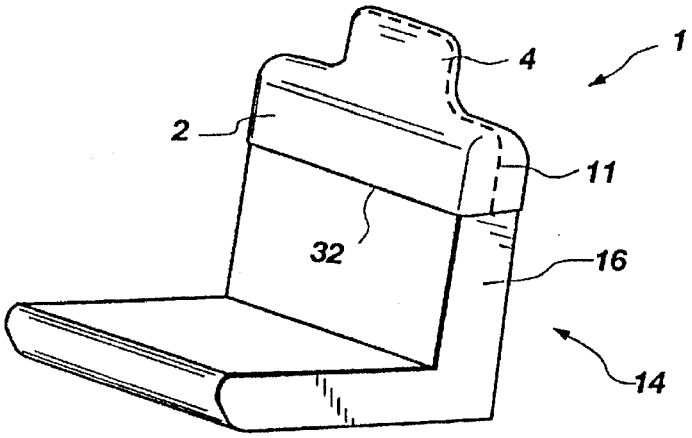
FIG. 5 is a perspective view of the cover of FIG. 1 placed upon the seat of FIG. 4; and, FIG. 6 is a perspective view of the cover as in FIG. 3 placed upon the seat of FIG. 4 but with the headrest removed.
Figure 6:
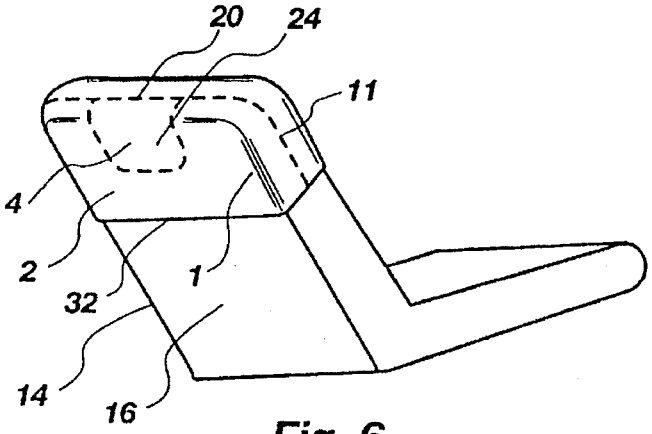

Referring to FIG. 1, there is shown the cover 1 with a seat section 2 and a head section 4. The cover 1 has a first sheet 6 and a second sheet 8, as shown in FIG. 2. The first sheet 6 and the second sheet 8 each have at least a contour edge 10. The contour edge 10 of the first sheet 6 and the second sheet 8 are attached by an attaching means, to form a contour edge seam 11, which is shown in FIGS. 5–6.

Figure 4:
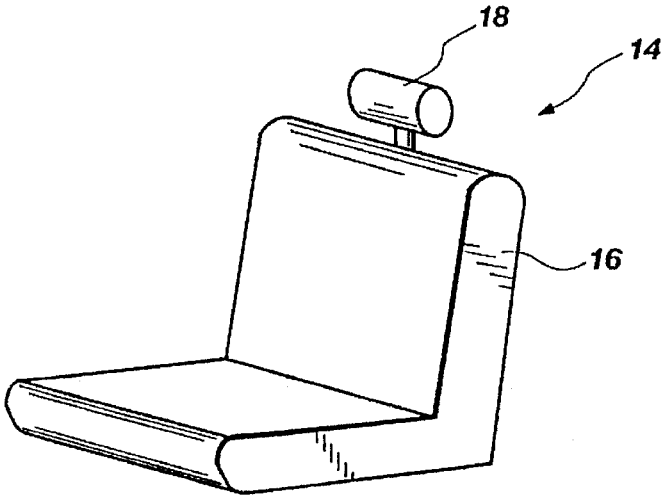
FIG. 4 is a perspective view of an automobile seat with a headrest.

The contour edge 10 of both the first sheet 6 and the second sheet 8, shown in FIG. 2, follow the general contour of the backrest 16 and the headrest 18 of a seat 14 shown in FIG. 4. When the front sheet 6 and the back sheet 8 are attached, forming the contour edge seam 11, the contour edge seam 11 follows the contour of the backrest 16 and the headrest 18 so that the cover 1 fits the seat 14, shown in FIG. 6.

The seat section 2 is flexible with respect to the headrest section 4. Furthermore, the contour edge seam 11 is flexible, allowing the headrest sections 4 to be folded inward, thereby forming an opening 20 as shown in FIG. 6 whereby the headrest sections 4 are disposed inside the cover 1, as shown in FIG. 6, the headrest sections forming an opening 20 and a pocket 24 as shown in FIG. 3 and 6.

Figure 3:
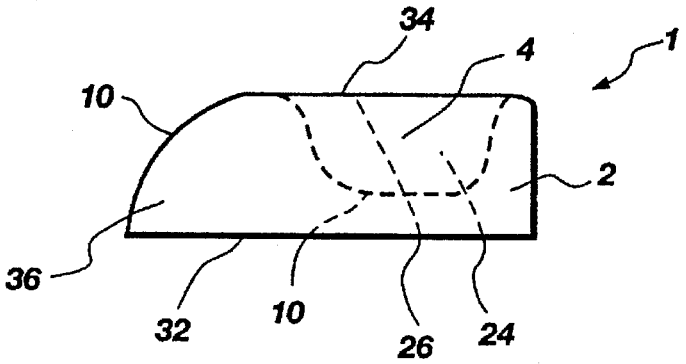
FIG. 3 is frontal view of the cover of FIG. 1 with the headrest pocket shown in phantom line, folded inwardly.

Referring to FIG. 3, the preferred embodiment of the present invention is shown as a main pocket 36 having lower open end 32 and an upper edge 34. The main pocket 36 is configured and dimensioned to envelop the upper portion of the backrest 16, shown in FIG. 4. As further shown in FIG. 3, a secondary pocket 24 having an open lower end 26 connects to the upper edge 34 of the main pocket 36 at the annular junction 40, shown in FIGS. 1–2.

The secondary pocket 24 shown in FIG. 3 and 6 is configured and dimensioned to be placed over the headrest 18 and backrest 16 to envelop the headrest 18 and follow the contours of the head rest 18 and backrest 16. When the secondary pocket is folded inside-out, an opening 20 is formed in the main pocket 36 at the annular junction. The opening 20 is formed through creasing along at least a portion of the annular junction 40 sufficient to fold the secondary pocket 24 inside-out. The annular junction 40 is substantially common to a single plane, not shown. The plane is substantially common to the remaining portion of the upper edge 34 of the main pocket 36 not having an opening 20.

FIG. 6 shows the opening 20, having the secondary pocket 24 formed by the headrest section 4 folded inside-out. The opening 20 forms a narrow slit which lies flat with respect to the above mentioned plane. Thus, the opening 20 falls along the contour edge seam 11 and fits the contour of the backrest 16 of the seat 14.

The present invention represents a significant advance over the prior apparatus, methods and art of seat covers. It is noted that many of the advantages of the present invention accrue do to the simplicity of the invention, making the invention easy to understand and use.

Although there exists prior art apparatus and methods for seat covers for use where seats have headrests, the prior art discloses the placement holes at the top of the seat cover to accommodate insertion of the headrest. Not only is a hole in the seat cover unpleasant to look at, but the headrest is not covered by the hole; thus, exposing the headrest.

The problems in the prior art are overcome by the present invention, which does not require a hole though the cover. The present invention covers the headrest if the headrest is in place. on the seat, and equally well covers the seat if the headrest is removed.

Further advantages come from the opening in the present invention, which is flat, and the pocket, in which various items may be stored. The pocket may have a closing device, such as a zipper, snaps, ties, Velcro™ or other closing means.

Additional advantages come from the various ways the pockets may be made. The pockets may be a unitary weave, netting, elastic material, plastic material, and all forms of both natural and man-made materials and fabrics. The pockets may be solid or have holes. The sheets of material may be solid, have holes, or comprise a number of separate members.

Those skilled in the art will appreciate from the preceding disclosure that the objectives stated above are advantageously achieved by the present invention.

While the present invention is described in terms of vehicle seat cover, it is to be understood that the subject apparatus and method may be used in any field of cover application. The above-described arrangements are only illustrative of the application of the principles of the invention. Numerous modifications and alternative arrangements may be devised by those skilled in the art without departing from the spirit and scope of the present invention and the appended claims are intended to cover such modifications and arrangements. Those having ordinary skill in the field of this invention will appreciate the advantages of the invention, and its application to a wide variety of cover uses.

What is claimed is:

1. A covering for a seat having a backrest, said covering comprising:

a main pocket made of flexible material having a lower open end, said main pocket being configured and dimensioned to envelop at least an upper portion of the backrest with said backrest protruding through the lower open end said main pocket including an upper edge and an opening form in a portion of said upper edge; and a secondary pocket having an open lower end connected to the upper edge of the main pocket and extending around the opening such that the secondary pocket and the main pocket are disposed in communication through said opening; the secondary pocket and the main pocket being connected together along an annular junction extending around the opening of the main pocket, the seat covering being creased along said annular junction in a manner sufficient to induce folding at the annular junction of the secondary pocket inside-out into the main pocket such that said main pocket is flush against said secondary pocket at the annular junction when folded inside-out.

2. The covering as defined in claim 1, wherein the seat covering is for use with a seat having a backrest and a headrest, and wherein the secondary pocket of the seat covering is configured and dimensioned to be placed over the headrest so as to envelop said headrest.

3. The covering as defined in claim 1, wherein the secondary pocket is further configured to extend from the upper edge of the main pocket inwardly into said main pocket when folded inside-out.

4. The covering as defined in claim 1, wherein said annular junction forms an opening in the upper edge of the main pocket that is a narrow slit.

5. The covering as defined in claim 4, wherein the annular junction is substantially common to a single plane.

6. The covering as defined in claim 5, wherein the plane is substantially common to the remaining portion of the upper edge of the main pocket not having the opening.

7. A cover for a seat having a backrest with a contour and a headrest with a contour, said cover comprising:

first and second sheets of flexible material, said sheets being substantially identical in shape and dimension to one another, each of said sheets having at least a contour edge, a backrest section and a headrest section, said contour edge matching the contour of the backrest and the contour of the headrest of the seat, said backrest section and headrest sections of said sheets positionable within said contour edge to correspond with the contours of said backrest and headrest of the seat, respectively;

attachment means for attaching a majority of the contour edge of said first sheet to a corresponding portion of the contour edge of said second sheet to form a contour edge seam, said contour edge seam being flexible so as to allow the headrest sections of the first and the second sheets to be folded inward to form an opening and pocket.

8. A cover as in claim 7, said flexible material being an elastic fabric.

* * * * *